350-276 SR
11/2/82 XR 4,356,921

United States Patent [19]

Fraenkel

[11] 4,356,921

[45] Nov. 2, 1982

[54] INSPECTION APPARATUS, E.G. FOR A SORTING MACHINE

[75] Inventor: Herbert Fraenkel, London, England

[73] Assignee: Gunson's Sortex Limited, London, England

[21] Appl. No.: 177,246

[22] Filed: Aug. 11, 1980

[30] Foreign Application Priority Data

Jan. 28, 1980 [GB] United Kingdom ..... 8002773

[51] Int. Cl.[3] ..... B07C 5/342

[52] U.S. Cl. ..... 209/576; 209/908; 209/932; 250/223 R; 350/63; 350/276 R; 356/446

[58] Field of Search ..... 209/576, 577, 578, 580, 209/581, 582, 908, 932; 350/61, 63, 276; 356/402, 445, 446; 250/223 R

[56] References Cited

U.S. PATENT DOCUMENTS

| | | | |
|---|---|---|---|
| 2,759,601 | 8/1956 | Baigent | 209/578 X |
| 2,776,747 | 1/1957 | Van Douwe | 209/908 X |
| 3,648,056 | 3/1972 | Buttweiler et al. | 350/276 SL |
| 4,074,808 | 2/1978 | Gillespie et al. | 209/587 |
| 4,147,619 | 4/1979 | Wassmer et al. | 209/587 X |

*Primary Examiner*—Joseph J. Rolla

[57] ABSTRACT

Inspection apparatus comprising a transparent or translucent tubular member having at least a frusto-conical portion, illuminating elements disposed externally of the tubular member for producing an illuminated zone within the frusto-conical portion, and a viewing arrangement disposed externally of the tubular member and arranged to view objects passing through the illuminated zone in the frusto-conical portion so as to respond to the value of a property of said objects, the tubular member reflecting substantially no light from the illuminated zone onto the viewing arrangement.

15 Claims, 3 Drawing Figures

INSPECTION APPARATUS, E.G. FOR A SORTING MACHINE

BACKGROUND OF THE INVENTION

This invention concerns an inspection apparatus, e.g. for use in a sorting machine.

Sorting machines are known in which objects to be sorted (e.g. agricultural products such as peas and beans, and mineral products such as pieces of ore) are fed to a transparent tubular member so as to fall therethrough under gravity. The objects falling through the tubular member are illuminated from the exterior of the tubular member and are also viewed from the said exterior, whereby the illuminating means and the viewing means employed are protected by the tubular member from dust associated with the objects. In such machines, however, considerable problems have arisen from the fact that the tubular member itself has reflected light onto the viewing means so that the response of the latter did not depend solely on light reflected or transmitted by the objects, whereby sorting efficiency was impaired. Many attempts have been made to solve the problem, but such attempts have not been very successful. Thus, for example, it is not practicable to blacken the areas which create the undesirable reflections since this would produce inadequate and uneven illumination.

BRIEF DESCRIPTION OF THE INVENTION

According, therefore, to the present invention, there is provided inspection apparatus comprising a transparent or translucent tubular member having at least a frusto-conical portion, illuminating means disposed externally of the tubular member for producing an illuminated zone within the frusto-conical portion, and viewing means disposed externally of the tubular member and arranged to view objects passing through the illuminated zone in the frusto-conical portion so as to respond to the value of a property of said objects, the tubular member reflecting substantially no light from the illuminated zone onto the viewing means. Thus since viewing occurs through the frusto-conical portion, the latter will not reflect light from the illuminated zone onto the viewing means, and the only light which it can reflect will be from a region beyond the ends of the tubular member. Consequently, if this region is kept dark, substantially no reflected light either from the illuminated zone or from the said region will fall onto the viewing means.

The term "frusto-conical portion" is used in this specification in a broad sense as including portions whose cross-sections are not necessarily circular but may be hexagonal or may have some other many sided shape. All such portions, however, have an opening at one end which differs in size from that of the other end.

Preferably, the tubular member has a frusto-conical portion adjoining a cylindrical portion, the viewing means being arranged to view through a part of the frusto-conical portion adjacent the cylindrical portion.

A background is preferably disposed externally of the tubular member, the viewing means being arranged to view the objects against the background.

Means are preferably provided for preventing a said object passing through the tubular member for creating a highlight which is viewed in line with the background. Thus the means for preventing the creation of a lightlight may comprise a member interposed in the line of a ray of light whose angle of incidence with the frusto-conical portion is such that the ray is reflected by the frusto-conical portion towards the viewing means.

Means are preferably provided for directing a fluid over the internal wall of the tubular member to reduce the accumulation of dust thereon. The fluid is preferably air.

The invention also comprises a sorting machine comprising a transparent or translucent tubular member having at least a frusto-conical portion; means for feeding objects to be sorted to the interior of the tubular member so as to fall therethrough under gravity; illuminating means disposed externally of the tubular member for producing an illuminated zone within the frusto-conical portion; viewing means disposed externally of the tubular member and arranged to view objects passing through the illuminated zone in the frusto-conical portion so as to respond to the value of a property thereof, the tubular member reflecting substantially no light from the illuminated zone onto the viewing means; and separator means, controlled by the viewing means, for effecting relative separation between objects which have and fail to have a predetermined value of said property.

The separator means may comprise a pneumatically operated ejector for directing compressed air onto predetermined objects which have passed through the tubular member.

BRIEF DESCRIPTION OF THE DRAWINGS

The invention is illustrated, merely by way of example, in the accompanying drawings, in which.

DESCRIPTION OF THE PREFERRED EMBODIMENT

Figure 1:
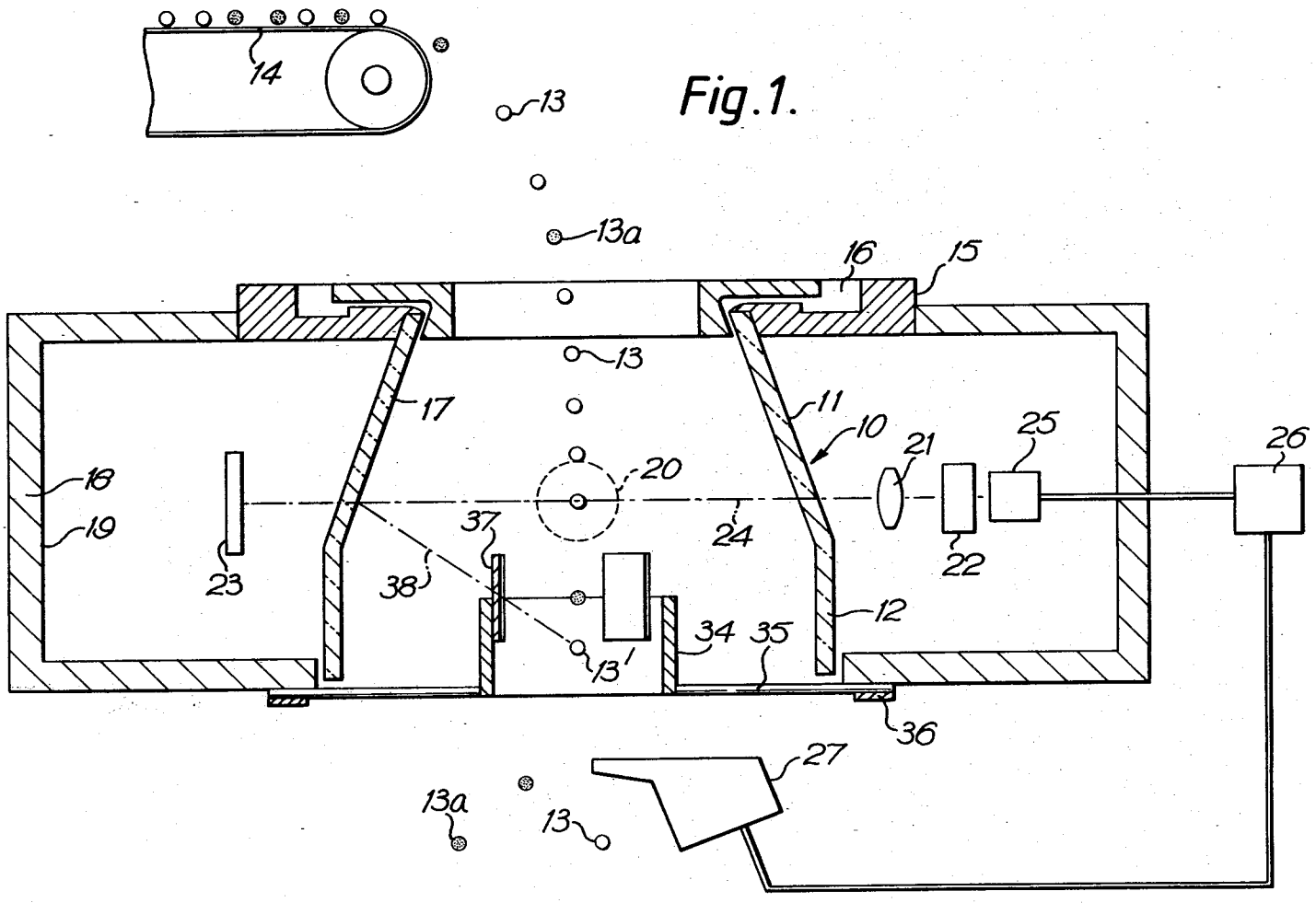
FIG. 1 is a diagrammatic view of a sorting machine according to the present invention.

Referring to FIG. 1, a sorting machine comprises a glass or other transparent or translucent tubular member 10 having an upper frusto-conical portion 11, whose diameter increases in a downward direction, the frusto-conical portion 11 adjoining a lower cylindrical portion 12. Objects 13, 13*a* to be sorted (e.g. coffee beans) are fed to the tubular member 10 by an horizontal endless belt 14, the objects 13, 13*a* falling therefrom under gravity so as to pass through the interior of the tubular member 10. By way of illustration only, the objects 13 are shown as relatively light objects while the objects 13*a* are shown as relatively dark objects, the purpose of the sorting operation being to effect relative separation between the objects 13, 13*a*.

The tubular member 10 is supported by a support member 15 having an annular air passage 16 therein which is arranged to receive compressed air from a source, not shown. The air passage 16 directs the compressed air over the internal wall 17 of the tubular member 10 to reduce the accumulation of dust thereon, such dust arising from the passage of the objects 13, 13*a* through the tubular member 10.

Three equi-angularly spaced apart lamps 20 (only one shown) are disposed externally of the tubular member 10. The lamps 20 illuminate the interior of a housing 18 having a highly diffused reflective surface 19. This produces an illuminated zone within the frusto-conical portion 11. Associated with each of the lamps 20 and disposed externally of the tubular member 10 are a respective viewing lens 21, a respective photocell 22, and a respective background 23 which is illuminated by the respective lamp 20. Each photocell 22, viewing lens 21 and background 23 are arranged on a viewing axis 24 which passes through the frusto-conical portion 11. Thus each viewing means constituted by a viewing lens 21 and a photocell 22 are arranged to view the objects 13, 13*a* which pass through the said illuminated zone against the background 23. As will be clear from FIG. 1, the said viewing means 21, 22 will view through a part of the frusto-conical portion 11 adjacent the cylindrical portion 12.

Each photocell 22 responds to the value of a property of the objects 13, 13*a* e.g. to the reflectance or light transmission thereof. Each photocell 22 is arranged to pass signals, by way of an amplifier 25, to a comparator 26 which controls operation of a pneumatically operated ejector 27. The signals from each photocell 22 are compared with a datum in the comparator 26, and when an object 13, 13*a* is viewed whose said property is below (or above) a predetermined value, a signal is sent to the ejector 27 to cause the latter to direct compressed air onto the respective object 13, 13*a* after the latter has passed through the tubular member 10, so as to remove the respective object 13, 13*a* from the other objects 13, 13*a*. Thus in the example illustrated in FIG. 1, the relatively dark objects 13*a* are shown as being deflected away from the relatively light objects 13. However, the arrangement could alternatively be that the relatively light objects 13 are deflected away from the relatively dark objects 13*a*.

Figure 3:
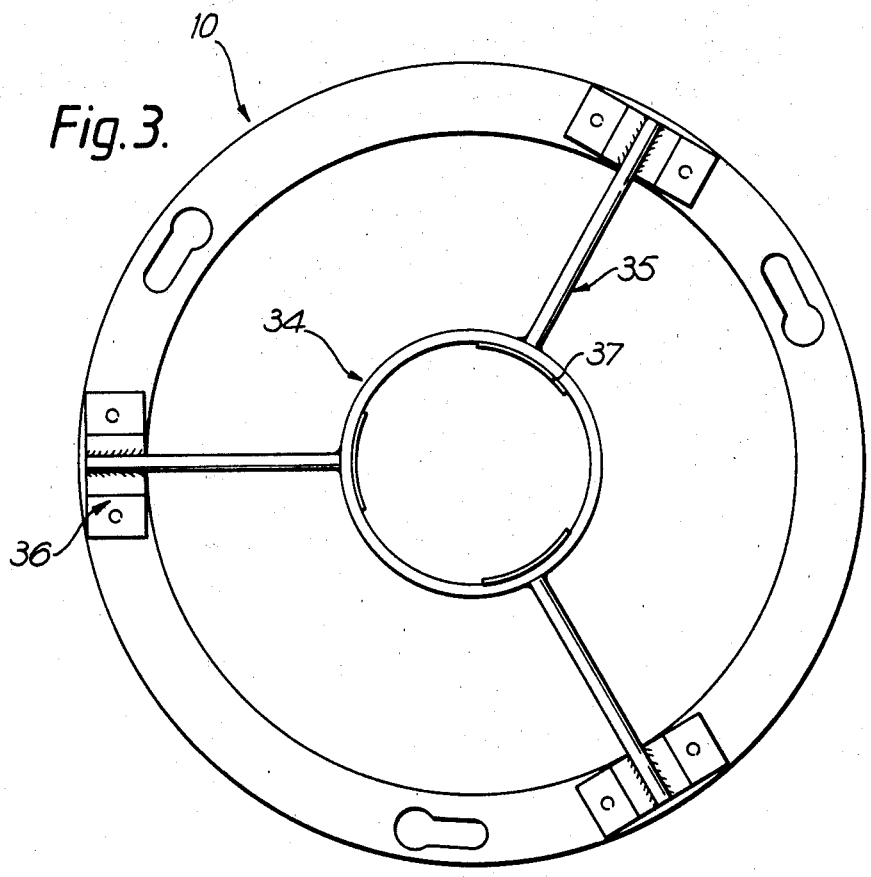
FIG. 3 is an underneath plan view of part of the structure shown in FIG. 1.

Mounted in the lower cylindrical portion 12 is a ring 34 which is held to the tubular member 10 by three equi-angularly spaced apart support rods 35, best seen in FIG. 3. The radially outer end of each support rod 35 is held in a respective bracket 36 which is secured to the housing 18. The ring 34 supports three equi-angularly spaced apart substantially circular black patches 37 which are respectively located to prevent the creation of highlights which would be viewed in line with the backgrounds 23. That is to say if one particular relatively light object 13' were located at the position shown, light would be reflected from it along a line 38 and this would, but for the provision of the respective patch 37, cause the production of a highlight which would be viewed in line with the respective background 23. In other words, the patch 37 is interposed in the line 38 of a ray of light whose angle of incidence with the frusto-conical portion 11 is such that the ray is reflected by the frusto-conical portion 11 towards the viewing means 21, 22. By reason of the provision of the patch 37, however, light travelling along the line 38 cannot reach the frusto-conical portion 11 and therefore cannot be reflected by the latter towards the viewing means 21, 22.

Since the viewing axis 24 passes through the frusto-conical portion 11, the latter will not reflect light from the said illuminated zone and onto the viewing means 21, 22. The only light which can be reflected by the frusto-conical portion 11 is from the region below the tubular member 10. This region, however, is kept dark and consequently substantially no reflected light either from the illuminated zone or from the said region will fall onto the viewing means 21, 22. Thus the provision of the frusto-conical portion 11 and patches 37 overcomes the problem of reflective highlights which are otherwise unavoidable due to the necessity to illuminate both the objects 13, 13*a*, and the backgrounds 23.

Figure 2:
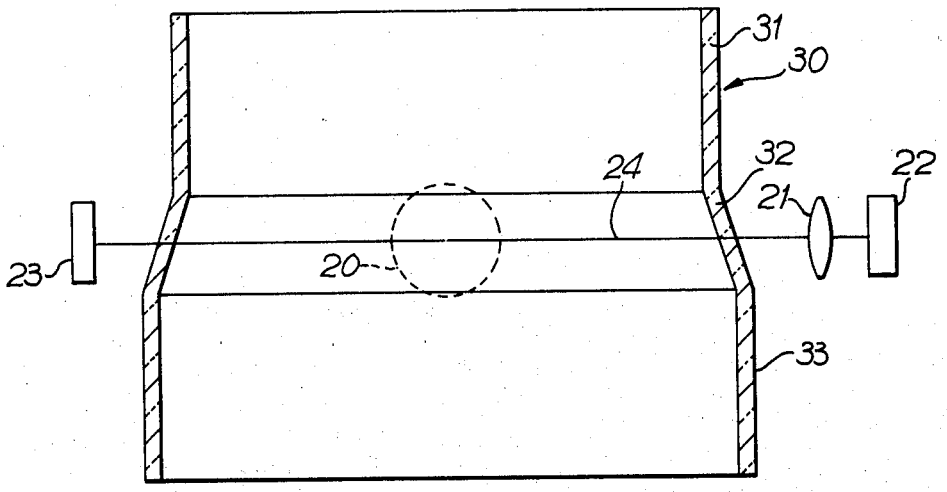
FIG. 2 illustrates a modification of a portion of the sorting machine of FIG. 1.

In FIG. 2 there is shown part of a modified sorting machine according to the present invention which is generally similar to that of FIG. 1 and which, for this reason, will not be described in detail, like reference numerals indicating like parts.

In the FIG. 2 construction, however, a transparent or translucent tubular member 30 is employed which has an upper cylindrical portion 31, a middle frusto-conical portion 32, and a lower cylindrical portion 33. The viewing axis 24 passes through the frusto-conical portion 32.

It is also possible, if desired, for the tubular member 10 to be completely frusto-conical.

I claim:

1. Inspection apparatus comprising a transparent or translucent tubular member having at least a frusto-conical portion, illuminating means disposed externally of the tubular member for producing an illuminated zone within the frusto-conical portion, and viewing means disposed externally of the tubular member and arranged on a viewing axis which passes only through the frusto-conical portion, the viewing means being arranged to view objects passing through the illuminated zone in the frusto-conical portion so as to respond to the value of a property of said objects, the tubular member reflecting substantially no light from the illuminated zone onto the viewing means.

2. Inspection apparatus as claimed in claim 1 in which the tubular member has a frusto-conical portion adjoining a cylindrical portion, the viewing means being arranged to view through a part of the frusto-conical portion adjacent the cylindrical portion.

3. Inspection apparatus as claimed in claim 2 comprising a background disposed externally of the tubular member, the viewing means being arranged to view the objects against the background.

4. Inspection apparatus as claimed in claim 3 comprising means for preventing a said object passing through the tubular member from creating a highlight which is viewed in line with the background.

5. Inspection apparatus as claimed in claim 4 in which the means for preventing the creation of a highlight comprises a member interposed in the line of a ray of light whose angle of incidence with the frusto-conical portion is such that the ray is reflected by the frusto-conical portion towards the viewing means.

6. Inspection apparatus as claimed in claim 1 comprising means for directing a fluid over the internal wall of the tubular member to reduce the accumulation of dust thereon.

7. Inspection apparatus as claimed in claim 6 in which the fluid is air.

8. A sorting machine comprising a transparent or translucent tubular member having at least a frusto-conical portion; means for feeding objects to be sorted to the interior of the tubular member so as to fall therethrough under gravity; illuminating means disposed externally of the tubular member for producing an illuminated zone within the frusto-conical portion; viewing means disposed externally of the tubular member and arranged on a viewing axis which passes only through the frusto-conical portion, the viewing means being arranged to view objects passing through the illuminated zone in the frusto-conical portion so as to respond to the value of a property thereof, the tubular member reflecting substantially no light from the illuminated zone onto the viewing means; and separator means, controlled by the viewing means, for effecting relative separation between objects which have and fail to have a predetermined value of said property.

9. A sorting machine as claimed in claim 8 in which the separator means comprises a pneumatically operated ejector for directing compressed air onto predetermined objects which have passed through the tubular member.

10. A sorting machine as claimed in claim 8 in which the tubular member has a frusto-conical portion adjoining a cylindrical portion, the viewing means being arranged to view through a part of the frusto-conical portion adjacent the cylindrical portion.

11. A sorting machine as claimed in claim 10 comprising a background disposed externally of the tubular member, the viewing means being arranged to view the objects against the background.

12. A sorting machine as claimed in claim 11 comprising means for preventing a said object passing through the tubular member from creating a highlight which is viewed in line with the background.

13. A sorting machine as claimed in claim 12 in which the means for preventing the creation of a highlight comprises a member interposed in the line of a ray of light whose angle of incidence with the frusto-conical portion is such that the ray is reflected by the frusto-conical portion towards the viewing means.

14. A sorting machine as claimed in claim 8 comprising means for directing a fluid over the internal wall of the tubular member to reduce the accumulation of dust thereon.

15. A sorting machine as claimed in claim 14 in which the fluid is air.

* * * * *